US011566299B2

(12) United States Patent
Qiao et al.

(10) Patent No.: US 11,566,299 B2
(45) Date of Patent: Jan. 31, 2023

(54) MARTENSITIC WEAR RESISTANT ALLOY STRENGTHENED THROUGH ALUMINUM NITRIDES

(71) Applicant: L.E. Jones Company, Menominee, MI (US)

(72) Inventors: Cong Yue Qiao, Menominee, MI (US); David M Doll, Fort Worth, TX (US)

(73) Assignee: L.E. Jones Company, Menominee, MI (US)

( * ) Notice: Subject to any disclaimer, the term of this patent is extended or adjusted under 35 U.S.C. 154(b) by 108 days.

(21) Appl. No.: 17/163,914

(22) Filed: Feb. 1, 2021

(65) Prior Publication Data

US 2022/0243296 A1 Aug. 4, 2022

(51) Int. Cl.

| | |
|---|---|
| ***F01L 3/02*** | (2006.01) |
| ***C21D 9/00*** | (2006.01) |
| ***C22C 38/52*** | (2006.01) |
| ***C22C 38/50*** | (2006.01) |
| ***C22C 38/48*** | (2006.01) |
| ***C22C 38/46*** | (2006.01) |
| ***C22C 38/44*** | (2006.01) |
| ***C22C 38/42*** | (2006.01) |
| ***C22C 38/06*** | (2006.01) |

(Continued)

(52) U.S. Cl.

CPC ..... *C21D 9/0068* (2013.01); *C21D 6/004* (2013.01); *C21D 6/005* (2013.01); *C21D 6/007* (2013.01); *C21D 6/008* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *F01L 3/02* (2013.01); *C21D 2211/005* (2013.01); *C21D 2211/008* (2013.01)

(58) Field of Classification Search

None

See application file for complete search history.

(56) References Cited

U.S. PATENT DOCUMENTS

| | | | |
|---|---|---|---|
| 3,859,081 | A | 1/1975 | Harvey et al. |
| 4,036,640 | A | 7/1977 | Philip et al. |

(Continued)

FOREIGN PATENT DOCUMENTS

WO WO-2012121630 A1 * 9/2012 ..... B21J 5/00

*Primary Examiner* — Humera N. Sheikh

*Assistant Examiner* — Kim S. Horger

(74) *Attorney, Agent, or Firm* — Buchanan Ingersoll & Rooney PC

(57) ABSTRACT

An iron-based alloy includes, in weight percent, carbon from about 0.75 to about 2 percent; manganese from about 0.1 to about 1 percent; silicon from about 0.1 to about 1 percent; chromium from about 3 to about 6 percent; nickel up to about 4 percent; vanadium from about 1 to about 3 percent; molybdenum from about 4 to about 7 percent; tungsten from about 4 to about 7 percent; cobalt from about 4 to about 7 percent; boron up to about 0.1 percent; nitrogen from about 0.001 to about 0.15 percent, aluminum from about 0.001 to about 0.6 percent, copper from about 0.1 to about 1 percent, sulfur up to about 0.3 percent, phosphorus up to about 0.3 percent, up to about 5 percent total of tantalum, titanium, hafnium and zirconium; iron from about 65 to about 80 percent; and incidental impurities.

11 Claims, 10 Drawing Sheets

(51) Int. Cl.

| | |
|---|---|
| ***C22C 38/04*** | (2006.01) |
| ***C22C 38/02*** | (2006.01) |
| ***C22C 38/00*** | (2006.01) |
| ***C21D 6/00*** | (2006.01) |
| ***C22C 38/54*** | (2006.01) |

(56) References Cited

U.S. PATENT DOCUMENTS

| | | | |
|---|---|---|---|
| 4,116,684 | A | 9/1978 | Uchida et al. |
| 4,116,685 | A | 9/1978 | Okuno |
| 4,140,527 | A | 2/1979 | Kawai et al. |
| 4,224,060 | A | 9/1980 | de Souza et al. |
| 5,525,140 | A | 6/1996 | Wisell |
| 5,674,449 | A | 10/1997 | Liang et al. |
| 6,436,338 | B1 | 8/2002 | Qiao |
| 6,702,905 | B1 | 3/2004 | Qiao et al. |
| 6,881,280 | B2 | 4/2005 | Qiao |
| 7,754,143 | B2 | 7/2010 | Qiao et al. |
| 8,168,009 | B2 | 5/2012 | Mesquita et al. |
| 8,430,075 | B2 | 4/2013 | Qiao et al. |
| 8,479,700 | B2 | 7/2013 | Qiao et al. |
| 8,613,886 | B2 | 12/2013 | Qiao et al. |
| 8,940,110 | B2 | 1/2015 | Qiao et al. |
| 9,334,547 | B2 | 5/2016 | Qiao et al. |
| 9,458,743 | B2 | 10/2016 | Qiao et al. |
| 9,932,867 | B2 | 4/2018 | Qiao et al. |
| 10,138,766 | B2 | 11/2018 | Qiao et al. |
| 10,677,109 | B2 | 6/2020 | Qiao et al. |

* cited by examiner

MARTENSITIC WEAR RESISTANT ALLOY STRENGTHENED THROUGH ALUMINUM NITRIDES

FIELD

The present disclosure relates to iron-based alloys, in particular to corrosion and wear-resistant iron-based alloys with high hardenability that may be used, for example, in valve seat inserts.

BACKGROUND

More restrictive exhaust emissions laws for diesel engines have driven changes in engine design including the need for high-pressure electronic fuel injection systems. Engines built according to the new designs use higher combustion pressures, higher operating temperatures and less lubrication than previous designs. Components of the new designs, including valve seat inserts (VSI), have experienced significantly higher wear rates. Exhaust and intake valve seat inserts and valves, for example, must be able to withstand a high number of valve impact events and combustion events with minimal wear (e.g., abrasive, adhesive and corrosive wear). This has motivated a shift in materials selection toward materials that offer improved wear resistance relative to the valve seat insert materials that have traditionally been used by the diesel and natural gas engine industry.

Another emerging trend in diesel and natural gas engine development is the use of EGR (exhaust gas recirculation). With EGR, exhaust gas is partially routed back into the intake air stream to reduce nitric oxide ($NO_x$) content in exhaust emissions. The use of EGR in diesel engines can change engine combustion characteristics and consequently the valve/VSI working environment. Accordingly, there is a need for lower cost exhaust valve seat inserts having suitable metallurgical and mechanical properties for use in diesel and natural gas engines using EGR.

Also, because exhaust gas contains compounds of nitrogen, sulfur, chlorine, and other elements that potentially can form acids, the need for improved corrosion resistance for alloys used in intake and exhaust valve seat insert applications is increased for diesel and natural gas engines using EGR. Acid can attack valve seat inserts and valves leading to premature engine failure.

There is a need for improved iron-based alloys for valve seat inserts that exhibit adequate hardness, mechanical strength, toughness as well as corrosion and wear resistance suitable for use in, for example, intake and exhaust valve seat insert applications.

SUMMARY

In embodiments, the present disclosure provides an iron-based alloy containing, in weight percent, carbon from about 0.75 to about 2 percent; manganese from about 0.1 to about 1 percent; silicon from about 0.1 to about 1 percent; cobalt from about 4 to about 7 percent; chromium from about 3 to about 6 percent; nickel up to about 4 percent; vanadium from about 1 to about 3 percent; molybdenum from about 4 to about 7 percent; tungsten from about 4 to about 7 percent; nitrogen from about 0.001 to about 0.15 percent; aluminum from about 0.001 to about 0.6 percent; copper from about 0.1 to about 1 percent; boron up to about 0.05 percent; sulfur up to about 0.3 percent; phosphorus up to about 0.3 percent; iron from about 65 to about 80 percent, and balance incidental impurities with up to about 5 percent total additional elements including niobium, tantalum, titanium, zirconium, and hafnium.

In embodiments, the present disclosure provides an iron-based alloy containing, in weight percent, carbon from about 0.75 to about 1.6 percent; manganese from about 0.2 to about 0.8 percent; silicon from about 0.2 to about 0.8 percent; cobalt from about 4.5 to about 5.5 percent; chromium from about 4 to about 5.5 percent; nickel from about 0.05 to about 2.5 percent; vanadium from about 1.2 to about 2 percent; molybdenum from about 5.5 to about 7 percent; tungsten from about 4.5 to about 5.5 percent; nitrogen from 0.05 to about 0.12 percent; aluminum from about 0.01 to about 0.6 percent; copper from about 0.2 to about 0.6 percent; boron from about 0.003 to about 0.01 percent; sulfur up to about 0.3 percent; phosphorus up to about 0.3 percent; iron from about 70 to about 76 percent; and balance incidental impurities, wherein the alloy has an as-cast microstructure with about 50 to about 80 volume percent intradendritic martensite and about 20 to about 50 volume percent interdendritic eutectoid phases.

In further embodiments, the present disclosure also provides a valve seat insert for use in an internal combustion engine. In embodiments, the valve seat insert is made of an iron-based alloy containing, in weight percent, carbon from about 0.75 to about 2 percent; manganese from about 0.1 to about 1 percent; silicon from about 0.1 to about 1 percent; cobalt from about 4 to about 7 percent; chromium from about 3 to about 6 percent; nickel up to about 4 percent; vanadium from about 1 to about 3 percent; molybdenum from about 4 to about 7 percent; tungsten from about 4 to about 7 percent; nitrogen from about 0.001 to about 0.15 percent; aluminum from about 0.001 to about 0.6 percent; copper from about 0.1 to about 1 percent; boron up to about 0.1 percent; sulfur up to about 0.3 percent; phosphorus up to about 0.3 percent; iron from about 65 to about 80 percent, balance incidental impurities with up to about 5 percent total additional elements including niobium, tantalum, titanium, zirconium, and hafnium.

In an embodiment, the valve seat insert is a cast alloy which includes, in weight percent, carbon from about 0.8 to about 1.2 percent; manganese from about 0.3 to about 0.7 percent; silicon from about 0.3 to about 0.7 percent; cobalt from about 4.5 to about 5.5 percent; chromium from about 4 to about 5.5 percent; nickel from about 0.15 to about 2.5 percent; vanadium from about 1.2 to about 1.6 percent; molybdenum from about 5.5 to about 7 percent; tungsten from about 4.5 to about 5.5 percent; copper from about 0.3 to about 0.5 percent; nitrogen from about 0.075 to about 0.1 percent; aluminum from about 0.01 to about 0.6 percent; boron from about 0.003 to about 0.01 percent; sulfur up to about 0.3 percent; phosphorus up to about 0.3 percent; iron from about 70 to about 76 percent; balance up to about 5 percent total additional elements including niobium, tantalum, titanium, zirconium, hafnium and incidental impurities, wherein the amount of nickel plus cobalt is 8 weight percent or less.

DETAILED DESCRIPTION

Disclosed herein is an iron-based alloy useful as a valve seat insert which will now be described in detail with reference to a few embodiments thereof, as illustrated in the accompanying drawings. In the following description, numerous specific details are set forth in order to provide a thorough understanding of the iron-based alloy. It will be apparent, however, to one skilled in the art that embodiments herein may be practiced without some or all of these specific details.

Unless otherwise indicated, all numbers expressing quantities, conditions, and the like in the instant disclosure and claims are to be understood as modified in all instances by the term "about." The term "about" refers, for example, to numerical values covering a range of plus or minus 10% of the numerical value. The modifier "about" used in combination with a quantity is inclusive of the stated value. In this specification and the claims that follow, singular forms such as "a", "an", and "the" include plural forms unless the content clearly dictates otherwise.

The terms "room temperature", "ambient temperature", and "ambient" refer, for example, to a temperature of from about 20° C. to about 25° C.

Figure 1:
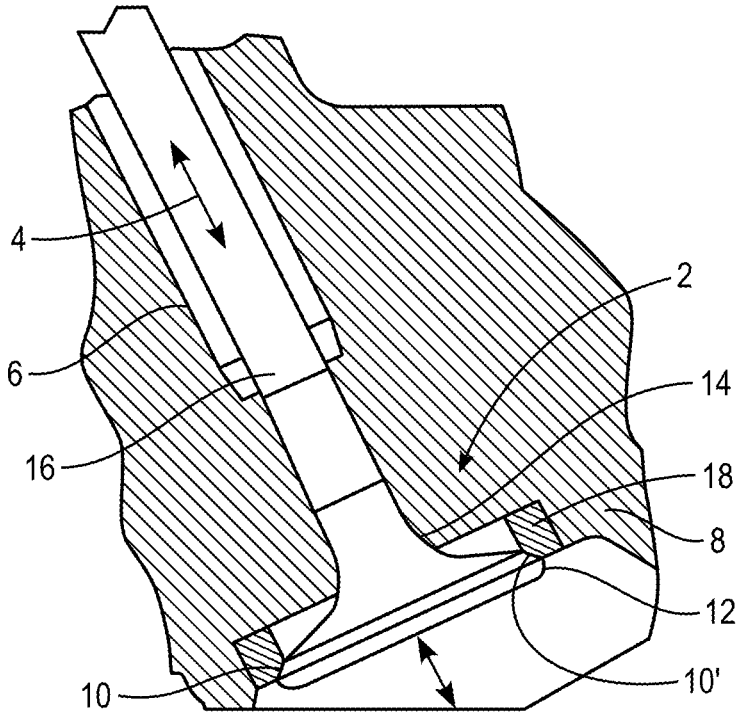
FIG. 1 illustrates an exemplary valve system which includes a valve seat insert that can be made of an alloy disclosed herein called J137.

FIG. 1 illustrates an exemplary valve assembly 2 according to the present disclosure. Valve assembly 2 may include a valve 4, which may be slidably supported within the internal bore of a valve stem guide 6 and a valve seat insert 18. The valve stem guide 6 may be a tubular structure that fits into the cylinder head 8. Arrows illustrate the direction of motion of the valve 4. Valve 4 may include a valve seat face 10 interposed between the cap 12 and neck 14 of the valve 4. Valve stem 16 may be positioned above the neck 14 and may be received within valve stem guide 6. The valve seat insert 18 may include a valve seat insert face 10' and may be mounted, such as by press-fitting, within the cylinder head 8 of the engine. In embodiments, the cylinder head 8 may comprise a casting of, for example, cast iron, aluminum, or an aluminum alloy. In embodiments, the insert 18 (shown in cross-section) may be annular in shape, and the valve seat insert face 10' may engage the valve seat face 10 during movement of valve 4.

In embodiments, the present disclosure relates to an iron-based alloy (referred to hereafter as "J137 alloy" or "J137"). The bulk hardness, hot hardness, high temperature strength, corrosion resistance, and wear resistance of the J137 alloy make it useful in a variety of applications including, for example, as a valve seat insert for an internal combustion engine, and in ball bearings, coating materials, and the like. In embodiments, the alloy is used as a valve seat insert for an internal combustion engine.

In embodiments, the J137 alloy comprises, in weight percent, carbon (C) from about 0.75 to about 2 weight percent; manganese (Mn) from about 0.1 to about 1 weight percent; silicon (Si) from about 0.1 to about 1 weight percent; cobalt (Co) from about 4 to about 7 percent; chromium (Cr) from about 3 to about 6 weight percent; nickel (Ni) up to about 4 weight percent; vanadium (V) from about 1 to about 3 weight percent; molybdenum (Mo) from about 4 to about 7 weight percent; tungsten (W) from about 4 to about 7 weight percent; copper (Cu) from about 0.1 to about 1 percent; nitrogen (N) from about 0.001 to about 0.15 percent; aluminum (Al) from about 0.001 to about 0.6 percent; boron (B) up to 0.1 percent; phosphorus (P) up to about 0.3 percent; sulfur (S) up to about 0.3 percent; iron (Fe) from about 65 to about 80 percent: balance up to about 5 percent total additional elements including niobium (Nb), tantalum (Ta), titanium (Ti), zirconium (Zr), hafnium (Hf) and incidental impurities which may include up to about 1 weight percent other elements, such as magnesium Mg), lead (Pb), antimony (Sb), tin (Sn), zinc (Zn), arsenic As), bismuth (Bi), calcium (Ca), cerium (Ce), selenium (Se), oxygen (0), yttrium (Y) and rare earth elements (lanthanides).

In embodiments, the J137 alloy consists essentially of, in weight percent, carbon from about 0.75 to about 1.6 percent; manganese from about 0.2 to about 0.8 percent; silicon from about 0.2 to about 0.8 percent; cobalt from about 4.5 to about 7 percent; chromium from about 3.5 to about 5.5 percent; nickel from about 0.05 to about 2.5 percent; vanadium from about 1.2 to about 1.6 percent; molybdenum from about 5 to about 7 percent; tungsten from about 4 to about 7 percent; copper from about 0.2 to about 0.6 percent; nitrogen from about 0.05 to about 0.12 percent; aluminum from about 0.01 to about 0.6 percent; boron from about 0.001 to about 0.05 percent; phosphorus up to 0.3 percent; sulfur up to 0.3 percent; iron from about 70 to about 76 percent; balance up about 5 percent total additional elements including niobium, tantalum, titanium, zirconium, hafnium and incidental impurities. As used herein, the terms "consists essentially of" or "consisting essentially of" have a partially closed meaning—that is to say, such terms exclude steps, features, or components which would substantially and adversely change the basic and novel properties of the alloy (i.e., steps or features or components which would have a detrimental effect on the desired properties of the J137 alloy). The basic and novel properties of the J137 alloy may include at least one of the following: hardness, thermal expansion coefficient, compressive yield strength, ultimate tensile rupture strength, wear resistance, corrosion resistance, and microstructure (i.e., substantially about 50 to about 80 volume percent intradendritic martensite and about 20 to about 50 volume percent interdendritic eutectoid phases).

In embodiments, the J137 alloy may be processed to achieve a combination of hardness, wear resistance, and corrosion resistance suitable for valve seat inserts in as-cast or stress relief heat treated or hardened and tempered condition. In embodiments, the J137 alloy may be processed according to any suitable method; for example, in embodiments, the J137 may be processed by conventional techniques including powder metallurgy, casting, thermal/plasma spraying, weld overlay, and the like.

In embodiments, the J137 alloy may be formed into a metal powder by any suitable technique. Various techniques for forming the alloy into a metal powder include, for example, ball milling elemental powders or atomization to form pre-alloyed powder. In embodiments, the powder material may be compacted into a desired shape and sintered. The sintering process may be used to achieve desired properties in the resulting part.

In embodiments, a valve seat insert may be manufactured by casting, which is a process involving melting alloy constituents and pouring the molten mixture into a mold. In embodiments, the alloy castings may be subsequently heat treated before machining into a final shape. In embodiments, a valve seat insert may be manufactured by machining a cast piece of the J137 alloy.

In embodiments, the J137 alloy may be used in the manufacture of valve seat inserts, such as valve seat inserts for use in diesel engines (for example, diesel engines with or without EGR). In embodiments, the J137 alloy may be used in other applications including, for example, valve seat inserts made for gasoline, natural gas, bi-fuel, or alternatively fueled internal combustion engines. Such valve seat inserts may be manufactured by conventional techniques. In addition, the J137 alloy may find utility in other applications, including, for example, applications in which high temperature properties are advantageous, such as wear resistant coatings, internal combustion engine components, and diesel engine components.

In embodiments, the J137 has a microstructure in the as-cast, quench and tempered state with about 50 to about 80 volume percent intradendritic tempered martensite and about 20 to about 50 volume percent interdendritic eutectic phases. After heat treating the cast alloy, the microstructure can include about 75 to about 90 volume tempered martensite and about 10 to about 25 volume percent carbides/eutectoid phases.

In embodiments, the J137 alloy may have a microhardness (as carried out with the Vickers HV10 scale under vacuum conditions) suitable for valve seat insert applications. In embodiments, the J137 alloy may have a high hardness from room temperature to elevated temperatures. For example, in embodiments, the J137 alloy may have a hardness HV(10) of over 600 at room temperature and over 400 at temperatures between room temperature and 1000° F.

Thermal conductivity of valve seat insert materials influences their performance in that a valve seat insert material with high thermal conductivity can more effectively transfer heat away from engine valves in order to prevent overheating.

In embodiments, the J137 alloy may have a high ultimate tensile strength and compressive yield strength suitable for use in valve seat insert applications. In general, a greater ultimate tensile strength corresponds to a greater resistance to insert cracking, and a greater compressive yield strength corresponds to high valve seat insert retention. In embodiments, the J137 alloy may have a compressive yield strength of greater than about 199 ksi and a tensile strength of greater than about 139 ksi at a temperature of about 75° F. In embodiments, the tensile strength at 1200° F. may be greater than about 132 ksi, such as greater than about 130 ksi. In embodiments, the difference between the tensile strength at 75° F. and that at 1200° F. may be less than about 10 ksi, such as less than about 7 ksi. In embodiments, the difference between the tensile strength at 75° F. and the tensile strength at 1000° F. may be less than about 28 ksi, such as less than about 25 ksi, or less than about 23 ksi.

In embodiments, the J137 alloy may have a radial crush toughness and thermal expansion suitable for valve seat insert applications.

Carbon (C) is an alloying element in the J137 alloy, which may affect alloy castability, microstructure, solidification substructure, and mechanical metallurgical behavior. Increasing carbon content can, at large, augment the hardenability of a martensitic type iron-based alloy. Carbon can form primary and secondary carbides with chromium, molybdenum, tungsten and vanadium and the carbon content can be used to achieve a desired amount of martensite. For instance, to increase the volume percent of tempered martensite, the J137 alloy can include carbon at the upper end of the carbon range. The J137 contains a relatively high amount of carbon which contributes to the high wear resistance of the J137 alloy. In embodiments, carbon may be present in the J137 alloy in an amount of from about 0.75 to about 2 weight percent, such as from about 0.8 to about 1.6 weight percent, or from about 0.8 to about 1.2 weight percent.

In embodiments, a small amount of boron (B) may also be used in the J137 alloy as an effective alloying element to increase the hardness level of the iron-based alloy system. Boron may also be used for solidification substructure cellular size refining. In embodiments, the J137 alloy may contain, for example, up to about 0.1% boron, from about 0.001 to about 0.05 weight percent boron, from about 0.003 to about 0.01 weight percent boron, or from about 0.003 to about 0.009 weight percent boron. Boron, which has a very low solubility in iron (e.g., about 0.01 wt. %), can be used to achieve a high level of hot hardness. Small amounts of boron can improve strength of the J137 alloy and can improve grain refinement through precipitation process (e.g., boron carbides, boron nitrides, boron carbonitrides). The distribution of boron can be both intragranular (within a grain) and intergranular (along grain boundaries). Excessive boron, however, can segregate to grain boundaries and degrade the toughness of the steel. By controlling the addition of boron in conjunction with other alloying additions, intragranular saturation of boron can be achieved which promotes the formation of boron compounds at the grain boundaries. These boron compounds can effectively enhance grain boundary strength. Without wishing to be bound by theory, it is believed that boron, both in solid solution and through the formation of boron compounds (e.g., compounds with C, Fe, Cr and/or Mo), can advantageously strengthen the steel by solid solution hardening and precipitation hardening preferably along solidification substructural boundaries and pre-austenitic grain boundaries. Additionally, boron may repress the eutectoid reaction in the J137 alloy system.

Manganese (Mn) is an austenite former and, in embodiments, may be present in the J137 alloy in an amount of, for example, from about 0.1 to about 1 weight percent, such as from about 0.2 to about 0.8 weight percent, or about 0.3 to about 0.7 weight percent. Manganese promotes austenite formation as a solute in iron-based matrix which increases the strength of the J137 alloy through solid solution strengthening as well as increase the resistance to oxidation. When the J137 alloy is formed into parts by casting, the addition of manganese can contribute to de-oxidation, desulfidation, and/or degassing of the J137 alloy.

In embodiments, the silicon (Si) content in the J137 alloy is from about 0.1 to about 1 weight percent, such as from about 0.2 to about 0.8 weight percent silicon, or about 0.4 to about 0.7 weight percent silicon. In embodiments, silicon can affect the castability through enhancing liquid metal fluidity and mode of solidification of the alloy by significantly vary constitutional super cooling condition in solid-liquid interface regions during a solidification process. Silicon can form a solid solution with iron and increase the strength of the J137 alloy through solid solution hardening as well as increase the resistance to oxidation. When the J137 alloy is formed into parts by casting, the addition of silicon can contribute to de-oxidation and/or degassing of the J137 alloy.

In embodiments, the alloy may contain chromium (Cr), a carbide and a ferrite former, in an amount of from about 3 to about 6 weight percent, such as from about 3.5 to about 5.5 weight percent chromium, or from about 4 to about 5.5 weight percent chromium. Thus, with the carbon content, chromium carbide is expected to be present in the hardened and tempered J137 alloy matrix which is one of the fundamental J137 alloy strengthening mechanisms. Additionally, the chromium content preferably provides a desirable combination of corrosion resistance, hardenability, wear resistance and oxidation resistance. Without wishing to be bound by theory, the chromium in the J137 alloy may form a dense, protective chromium oxide layer on the surface of the J137 alloy that inhibits high temperature oxidation and minimizes wear and corrosion.

In embodiments, nickel (Ni), an austenite former, may be present in the J137 alloy in an amount of, for example, up to about 4 weight percent nickel, from about 0.05 to about 2.5 weight percent nickel, or about 0.15 to about 2.5 weight percent nickel. Nickel may be present in the J137 alloy in an amount that does not adversely affect the desired properties of the J137 alloy. Nickel can advantageously increase the resistance to oxidation and corrosion and can also increase the hardness and strength of the J137 alloy via secondary phase strengthening. Nickel may be an austenite former, and too much nickel may enlarge the size of the austenitic region in the J137 alloy, which may result in an increase in the coefficient of thermal expansion and a decrease in the low temperature wear resistance of the J137 alloy. Therefore, the role of nickel is to strengthen the matrix phase through solid-solution strengthening. Although nickel does not form carbides in iron-based alloys, the addition of nickel to the J137 alloy can be used to augment elevated temperature strength and hot hardness.

Vanadium (V) is a carbide former and may, in embodiments, be present in the J137 alloy in an amount of, for example, from about 1 to about 3 weight percent, such as from about 1.2 to about 2 weight percent vanadium, or about 1.2 to about 1.6 weight percent vanadium. Vanadium can be included in the iron-based alloy in an amount effective to improve the wear resistance and corrosion resistance of the iron-based alloy.

In embodiments, molybdenum (Mo), which is also a carbide former, may be present in the J137 alloy in an amount of, for example, from about 4 to about 7 weight percent molybdenum, such as from about 5 to about 7 weight percent molybdenum, from about 5.5 to about 7 weight percent molybdenum. Molybdenum is a carbide former and is likely to combine with chromium to form primary carbides. The addition of molybdenum may also increase localized corrosion resistance in the J137 alloy. Molybdenum can contribute to reducing intergranular stress corrosion, stress corrosion cracking and/or pitting corrosion.

In embodiments, the J137 alloy can include tungsten (W) in an amount of, for example, from about 4 to about 7 weight percent tungsten, such as from about 4.5 to about 6 weight percent tungsten, or about 4.5 to about 5.5 weight percent tungsten. Tungsten is a very effective solid solution alloying element for iron-based alloys such as J137. Tungsten also is a carbide former and can be included in the iron-based alloy in an amount effective to improve the wear resistance and corrosion resistance of the iron-based alloy.

In embodiments, the J137 alloy may contain cobalt (Co) in a suitable amount. For example, in embodiments, the J137 alloy may contain from about 4 to about 7 weight percent cobalt, such as from about 4.5 to about 6 weight percent cobalt, or about 4.5 to about 5.5 weight percent cobalt. Preferably, a total cobalt plus nickel content is up to about 8 weight percent or about 5 to about 8 weight percent. Cobalt can be included in the iron-based alloy in an amount effective to improve the high temperature wear resistance and high temperature corrosion resistance of the iron-based alloy.

In embodiments, the J137 alloy may also contain aluminum (Al) in an amount of about 0.001 to about 0.6 weight percent aluminum, or about 0.01 to about 0.6 weight percent aluminum and nitrogen can be present in an amount of about 0.001 to about 0.15 weight percent nitrogen or from about 0.05 to about 0.12 weight percent nitrogen or about 0.075 to about 0.1 weight percent nitrogen. The aluminum preferably combines with nitrogen to form aluminum nitride (AlN) particles in an amount of about 0.005 to about 0.05 volume percent, or about 0.01 to about 0.05 volume percent. The aluminum nitride particles have a hexagonal close packed structure and have particle sizes of about 0.5 to about 10 microns or about 1 to about 5 microns randomly distributed in the alloy.

In embodiments, the J137 alloy can include copper (Cu) in amounts of about 0.1 to about 1 weight percent. For example, copper can be included in amounts of from about 0.2 to about 0.6 weight percent of from about 0.3 to about 0.5 weight percent copper. The copper may be present as a fine and uniform distribution of precipitated epsilon copper.

The J137 alloy can have optional additions of other alloying elements, or may be free of intentional additions of such elements. In embodiments, the balance of the J137 alloy is iron (Fe) in amounts of about 65 to about 80 weight percent iron or from about 70 to about 76 weight percent iron and incidental impurities. The J137 alloy may contain up to about 5 percent total additional elements including niobium (Nb), tantalum (Ta), titanium (Ti), zirconium (Zr), hafnium (Hf). In embodiments, the additional elements can be up to about 3 percent or up to about 1 percent in total. Incidental impurities, which can include up to about 1.5% total weight percent other elements, such as arsenic (As), bismuth (Bi), calcium (Ca), magnesium (Mg), oxygen (O), lead (Pb), tin (Sn), yttrium (Y) and rare earth elements (REM, also called lanthanides), zinc (Zn) and selenium (Se). In embodiments, the J137 alloy contains less than about 0.5 weight percent impurities, such as less than about 0.3 weight percent impurities.

In embodiments, the J137 alloy is free of intentional additions of phosphorus (P), sulfur (S), arsenic, bismuth, calcium, magnesium, oxygen, lead, tin, yttrium, rare earth elements, zinc, selenium, niobium, tantalum, titanium, hafnium and zirconium. The phrase "free of intentional additions" indicates, for example, that such elements are not intentionally added, but may be incidentally present due to processing materials and conditions. For example, additional impurities may be present in stock used to make alloys. Further, because sulfur and phosphorus are common impurities which are removed during alloy preparation, complete elimination of these elements from the alloy may not be cost effective. In embodiments, the alloy may contain less than about 0.3 weight percent sulfur and/or less than about 0.3 weight percent phosphorus.

In embodiments, the content of sulfur is preferably less than about 0.1 weight percent and the content of phosphorus is preferably less than about 0.1 weight percent. For example, phosphorus and sulfur may each be present in the alloy in an amount less than about 0.06 weight percent, such as up to about 0.05 weight percent, or from about 0.001 to about 0.03 weight percent, or from about 0.01 to about 0.02 weight percent phosphorus and/or sulfur.

In embodiments, the J137 alloy can be cast into a desired shape such as valve seat inserts, which are heat treated by heating to a temperature in the austenitic range (for example to about 1700° F.), quenching to transform the microstructure into about 50 to about 80 volume percent martensite and about 20 to about 50 volume percent eutectoid phases, followed by tempering to toughen the alloy (for example, tempering at about 1100 to about 1350° F.)'

EXAMPLES

The examples set forth herein below are illustrative of different compositions and conditions that may be used in practicing the embodiments of the present disclosure. All proportions are by weight unless otherwise indicated. It will be apparent, however, that the embodiments may be practiced with many types of compositions and can have many uses in accordance with the disclosure above and as pointed out hereinafter.

The J137 alloy can be used to make valve seat inserts by forming a melt of the alloy constituents, deoxidizing the melt with an aluminum addition shortly before casting, casting the alloy, and subjecting the casting to tempering to obtain a microstructure comprising intradendritic tempered martensite and interdendritic eutectoid phases. Due to aluminum nitride formation takes place in liquid metal prior to bulk matrix solidification process, the aluminum nitride nucleuses can effectively reduce solidification substructure size. Further, precipitation of epsilon copper takes place during the heat soaking during hardening and temperature processing can reduces grain growth during hardening and tempering process thus, a desired uniform and fine cellular microstructure can be obtained.

In an embodiment, the J137 alloy can be characterized as a fine-grained martensitic alloy with copper precipitation hardening, pre-austenitizing process and dispersive aluminum nitride strengthening design. Three primary differences between the J137 alloy and an M2 tool steel and the J120V alloy are: (1) addition of a desired amount of cobalt and nickel to ensure adequate austenitizing is realized; (2) addition of an adequate amount of copper for precipitation hardening and pre-austenite grain size control, and (3) adding aluminum as an aluminum nitride former. By combining these three alloy design criteria, the J137 alloy can be provided with grain size refining, matrix strengthening, and nitrides distribution formation useful for engine valvetrain components such as valve seat insert (VSI) applications.

Alloy J137 has a tempered martensitic matrix in a desired hardened+tempered condition with a small amount retained austenite. The amount of tempered martensitic within an air quench and tempered state is with about 50 to about 80 volume %. Another portion of the alloy is composed of eutectic/eutectoid lamella phases which is about 10 to about 50 volume % of J137 matrix. During J137 solidification process, intradendritic regions are composed of solid solution phase (austenite/ferrite/martensite). The interdendritic regions are composed of solidified and form eutectic reaction phases (austenite and carbides in lamella distribution). At a lower temperature, eutectoid reaction takes place to form ferrite and carbides in lamellar morphology).

During quenching, the ferritic portions of pre-eutectoid reactants change into martensitic structures through solid state phase transformation which later transforms into tempered martensite after a tempering treatment. Therefore, in a hardened plus tempered condition, the J137 alloy can contain about 5 to 25 volume % of eutectoid carbides which are rich in chromium, molybdenum, tungsten, and vanadium.

Aluminum nitride (AIN) possesses a high thermal conductivity (around 160 W/mK) at ambient), high microhardness hardness (HK1200 at ambient), and matchable thermal expansion coefficient to be bonded with carbide and tempered martensitic crystalline structures. AIN synthesized with aluminum and nitrogen elements can have a Wurtzite crystalline structure. The nitride structure formed with covalent bonds is stable up to 2000° C. in an oxygen depleted environment. AIN can be successfully introduced in J137 for augmenting the alloy wear resistance under adhesive and abrasive conditions. Because of the designed process for AIN formation in the J137 alloy system, aluminum nitride formation takes place at elevated temperature while bulk alloy metal is in liquid state. The formation of AIN nuclei occurs in random locations of the liquid J137 metal for which both aluminum and nitrogen as solutes, incipiently. Therefore, uniform in size and random distribution of AIN are expected.

The precipitation of epsilon copper can be readily taken place within boundaries between eutectoid ferrite and carbide in an iron-based alloy system. Epsilon copper precipitation typically occurs at or around eutectoid temperature which can strengthen the matrix and refine the grain size. Epsilon copper as an interphase in an iron-based matrix is very stable and can resist both precipitation dissolution and particle growth in an engine valve train application temperature range. A small amount of copper can be included in the J137 alloy for introducing epsilon copper precipitation formation.

Table 1 lists the composition of seven J137 experimental heats wherein a total amount of cobalt plus nickel is less than 8.0 wt. % and the copper content is 0.30 to 0.50 wt. %. The heats include various aluminum contents to explore the influence of nitride formation to mechanical and metallurgical responses in the alloy system. Aluminum nitride formation is designed for the alloy to enhance its wear resistance especially for minimizing high temperature adhesive wear. The heats contain up to about 1% incidental impurities including up to about 0.03% Mg, up to about 0.015% Pb, up to about 0.05% Sb, up to about 0.03% Sn, up to about 0.02% Zn, up to about 0.02% As, up to about 0.1% Bi, up to about 0.001% Ca, up to about 0.1% Ce, up to about 0.02% Zr, up to about 0.003% La, and up to about 0.03% Se.

TABLE 1

Composition of J137 Experiments.

| Heat | 0B12R | 0H28XA | 0I02XA | 0I08XA | 0J07XA | 0J12XA | 0L02XB | 0L22XB |
|---|---|---|---|---|---|---|---|---|
| C | 1.2 | 1.27 | 1.13 | 1 | 0.94 | 0.85 | 1.16 | 1.18 |
| Mn | 0.384 | 0.8 | 0.64 | 0.365 | 0.383 | 0.372 | 0.433 | 0.560 |
| Si | 0.65 | 0.76 | 0.81 | 0.56 | 0.78 | 0.71 | 0.61 | 0.63 |
| Ni | 0.148 | 0.483 | 0.146 | 0.236 | 1.96 | 1.66 | 0.5 | 0.479 |
| Cr | 4.26 | 4.68 | 4.74 | 4.37 | 5.09 | 5.3 | 4.53 | 4.53 |
| Mo | 5.98 | 6.53 | 6.11 | 6.15 | 5.85 | 6.15 | 6.51 | 6.67 |
| Cu | 0.387 | 0.464 | 0.381 | 0.409 | 0.364 | 0.395 | 0.479 | 0.442 |
| W | 4.62 | 5.49 | 5.27 | 5.23 | 5.41 | 4.95 | 5.17 | 4.56 |
| V | 1.27 | 1.53 | 1.4 | 1.41 | 1.57 | 1.5 | 1.38 | 1.4 |
| Co | 4.82 | 5.08 | 4.81 | 4.92 | 5.22 | 5.41 | 4.96 | 4.86 |
| Al | 0.042 | 0.272 | 0.162 | 0.078 | 0.445 | 0.236 | 0.457 | 0.540 |
| B | 0.0094 | 0.011 | 0.0081 | 0.0081 | 0.011 | 0.01 | 0.0082 | 0.0077 |
| N | 0.084 | 0.054 | 0.064 | 0.064 | 0.061 | 0.068 | 0.073 | 0.051 |
| P | 0.037 | 0.034 | 0.032 | 0.032 | 0.032 | 0.031 | 0.031 | 0.031 |
| S | 0.021 | 0.014 | 0.016 | 0.016 | 0.015 | 0.015 | 0.015 | 0.016 |
| Nb | 0.025 | 0.059 | 0.085 | 0.042 | 0.91 | 0.7 | 0.134 | 0.121 |
| Ti | 0.041 | 0.028 | 0.036 | 0.024 | 0.046 | 0.047 | 0.037 | 0.023 |
| Ta | 0.11 | 0.1 | 0.092 | 0.11 | 0.01 | 0.067 | 0.089 | 0.153 |
| Fe | 75.7 | 72 | 73.8 | 74.7 | 70.7 | 71.3 | 73.2 | 73.5 |

Radial crush testing was used to assess the alloy toughness with a tensile tester. During the testing, a ring-shaped test sample with dimensions of 1.935"OD, 1.750"ID, and 0.3050" height was pressed on the OD surface until it ruptured. Then, the rupture load and deformation were used to calculate the radial crush toughness. Five samples were tested in an as-cast condition from six of the J137 alloy heats and a standard J120V alloy which had 1.32% C, 0.36% Mn, 0.428% Si, 0.08% Ni, 3.9% Cr, 6.68% Mo, 0.08% Cu, 5.46% W, 1.42% V, 0.1% Co, 0.0268% N, 0.001% Al, and 80.2% Fe. For the J137 alloy, different heats were applied with different amount of aluminum plunging material in the molten metal just before casting sample pouring. Different amounts of aluminum plunging introduced different amounts of aluminum nitride particles in the alloy matrix. The alloy solidification mode was designed to assist a dispersive distribution formation of fine aluminum nitrides.

Figure 2:
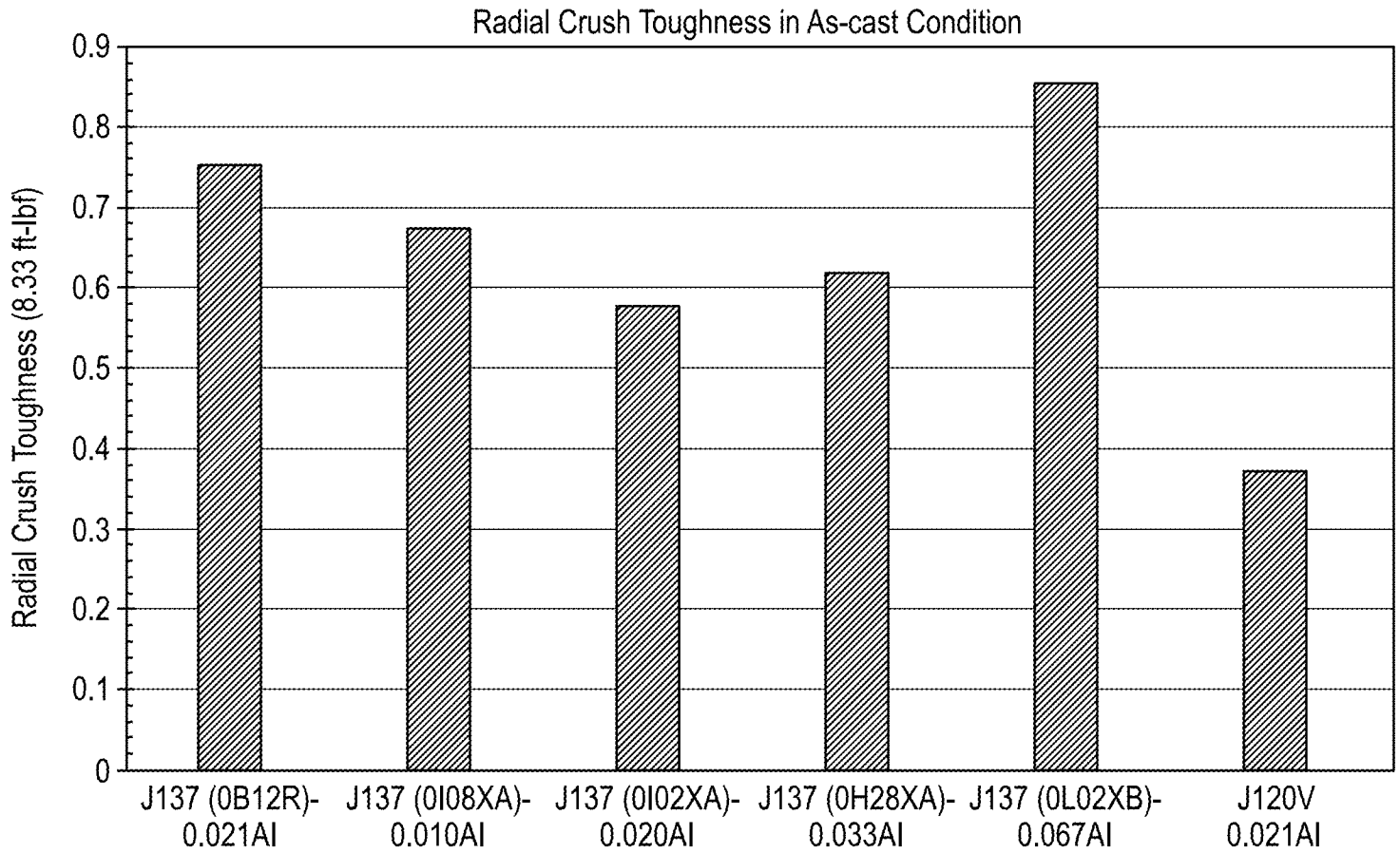
FIG. 2 is a graph of radial crush toughness for various J137 alloys versus J120V.

The radial crush test results of these heats is illustrated in FIG. 2. Most likely, the radial crush toughness of alloy J137 is a function of aluminum content. The results indicate that all of the J137 experimental heats exhibit a higher radial crush toughness than the standard J120V alloy in an as-cast condition. Therefore, the casting cracking propensity of J137 should be lower than J120V.

Figure 3:
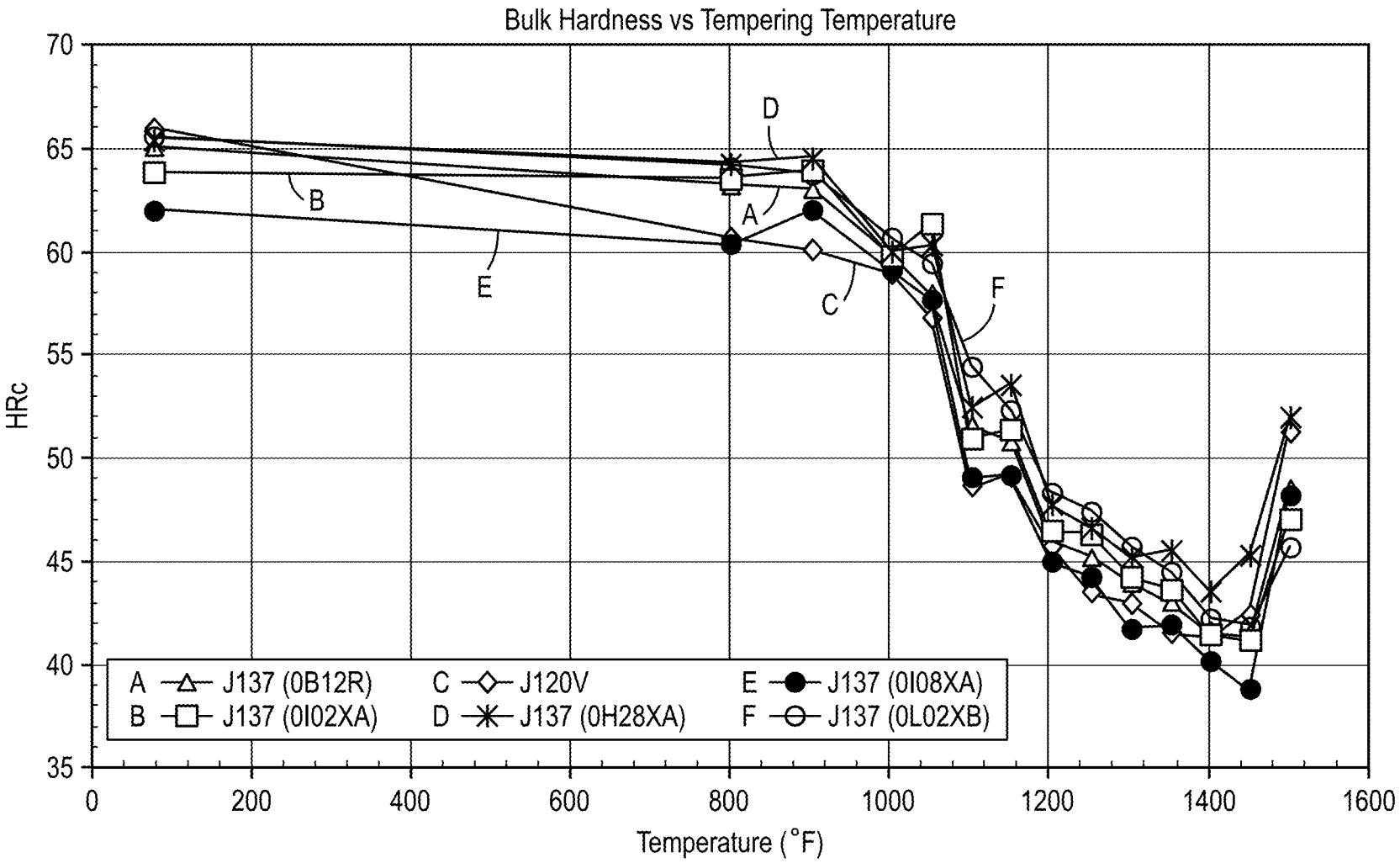
FIG. 3 is a graph of hardness versus tempering temperature for various J137 alloys.

Temper response behavior of J137 is compared with J120V in FIG. 3 which plots bulk hardness as a function of tempering temperature. In general, the J137 alloy exhibits an equal or higher bulk hardness than J120V within a tempering temperature range from ambient to 1500° F.

Figure 4:
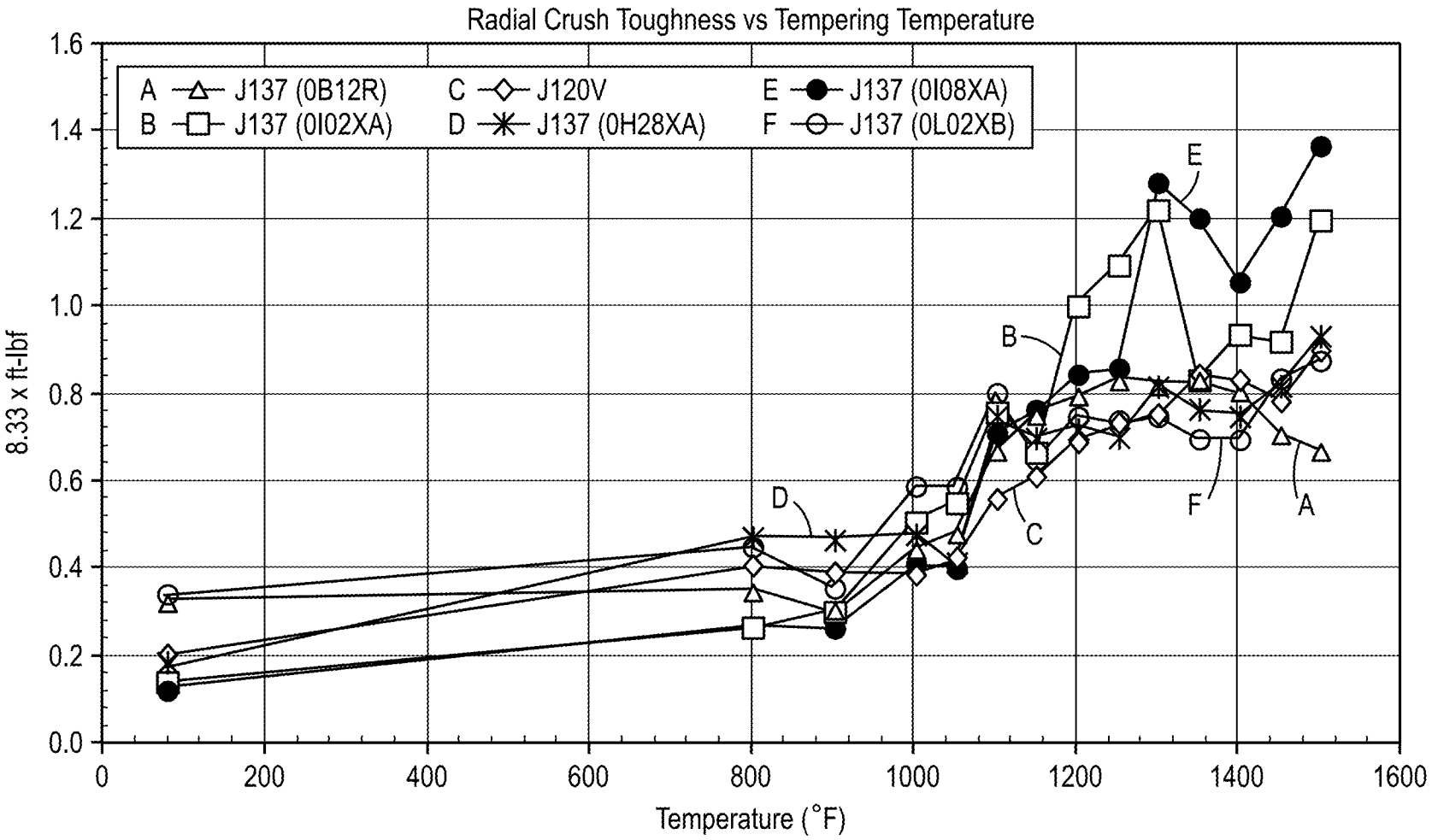
FIG. 4 is a graph of radial crush toughness versus tempering temperature for various J137 alloys.

FIG. 4 shows radial crush toughness as a function of tempering temperature. All J137 experimental heats exhibit an equal or better radial crush toughness than the J120V alloy (a classical VSI alloy). Therefore, alloy J137 can be expected to have a sufficient toughness for valve train component applications.

Figure 5:
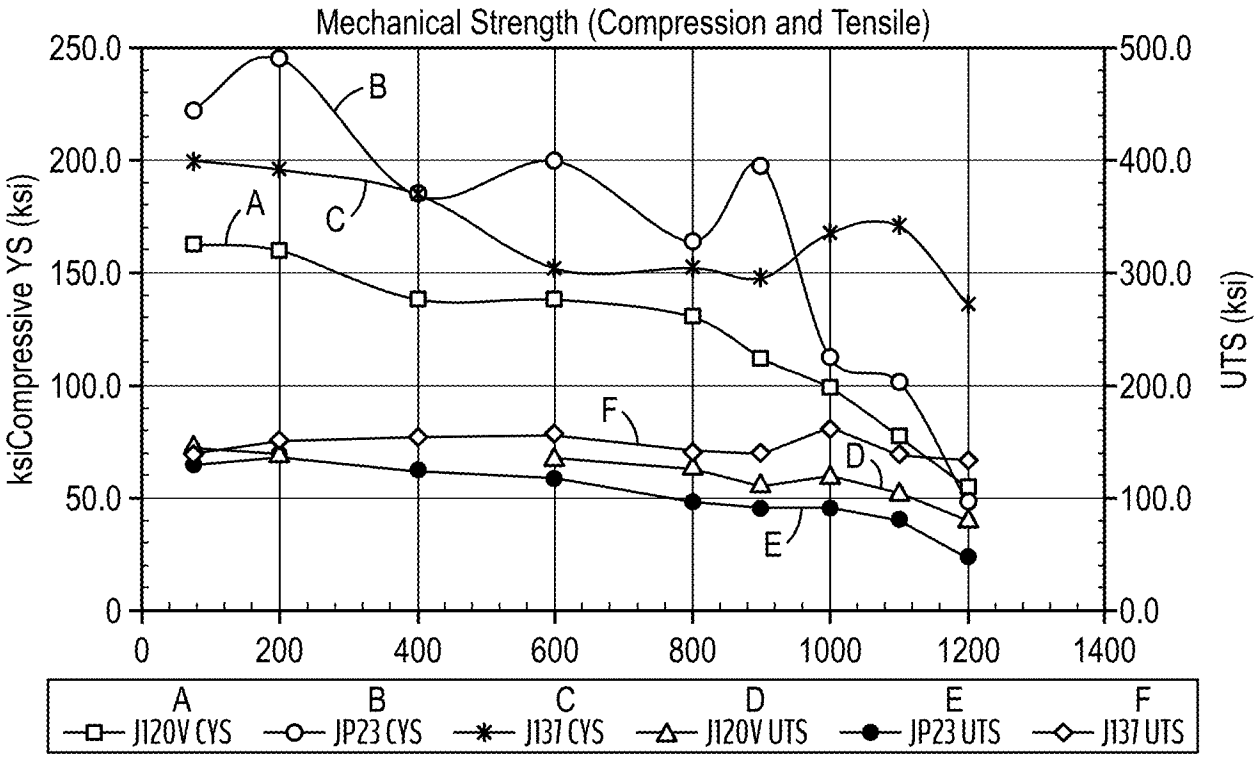
FIG. 5 is a graph of compressive yield strength and tensile strength for various J137 alloys.

FIG. 5 shows a comparison of compressive yield strength and tensile rupture strengths between J120V, JP23 and J137. For compressive yield strength, J137 possesses a desired high temperature behavior and from 600° F. through 1200° F. compared to JP23 (an PM VSI material) and J120V. For tensile behavior, J137 possessed the highest tensile rupture strength among J120V, JP23, and J137.

Figure 6:
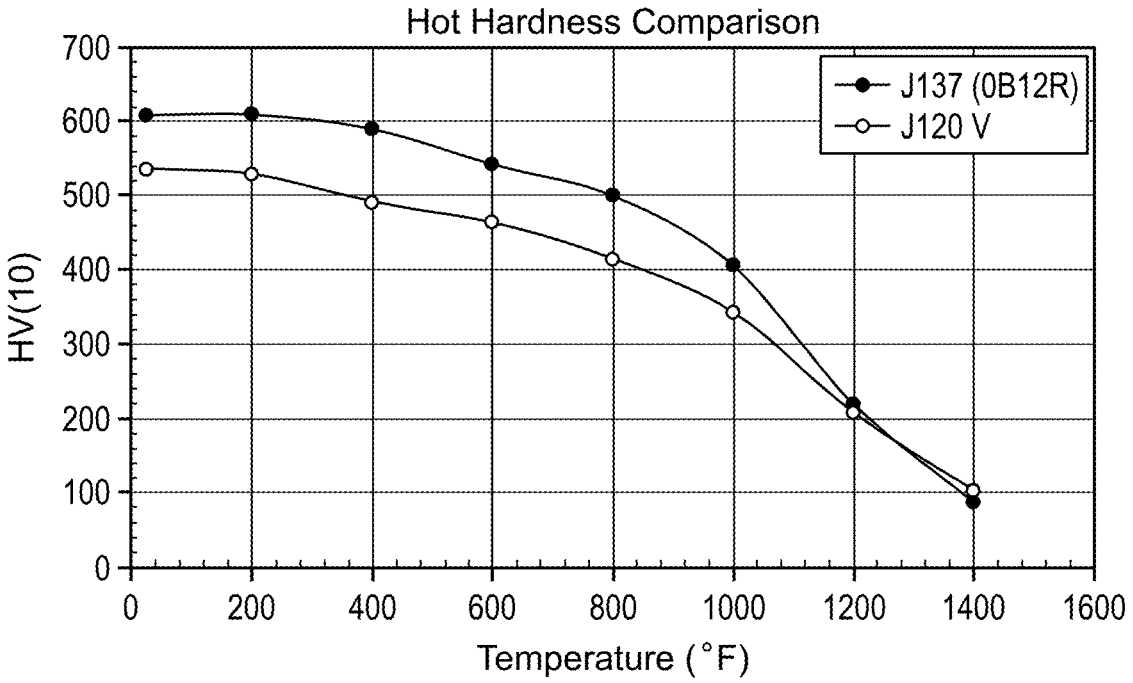
FIG. 6 is a graph of hot hardness versus temperature for various J137 alloys.

FIG. 6 shows a comparison of hot hardness between J120V and J137 and, clearly J137 possessed an overall higher hot hardness than J120V. Therefore, from a hot hardness consideration, J137 has a high potential for elevated temperature applications including VSI. From a tribological application consideration, the higher the hot hardness, the better the high temperature wear resistance. Therefore, J137 is expected to possess a higher potential of desired wear resistance.

Figure 7:
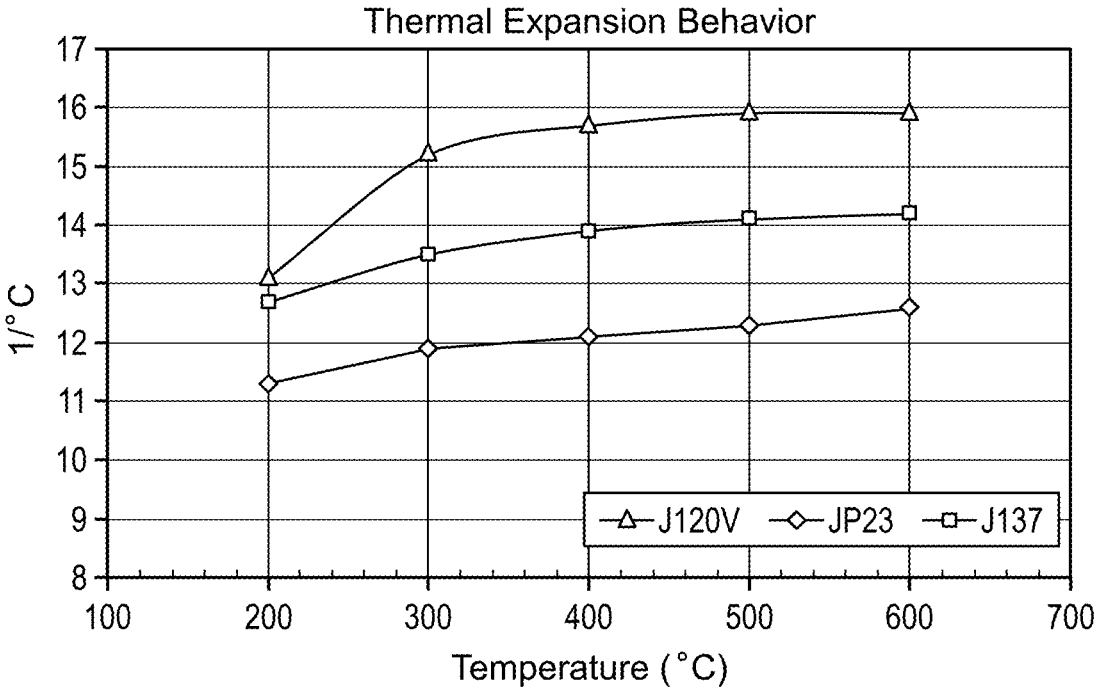
FIG. 7 is a graph of thermal expansion of various J137 alloys.

FIG. 7 is a comparison of thermal expansion coefficient among J120V, JP23, and J137. Alloy J137 possesses a thermal expansion coefficient in between of J120V and JP23. The thermal expansion coefficient exhibited in FIG. 7 is suitable for valve train component applications.

Figure 8:
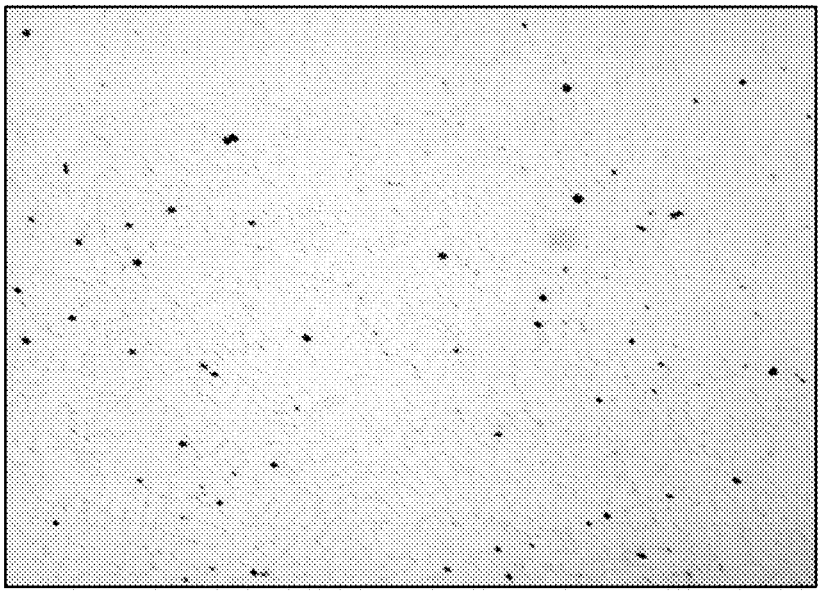
FIG. 8 is a photomicrograph at 100× of a cast J137 alloy.
Figure 9:
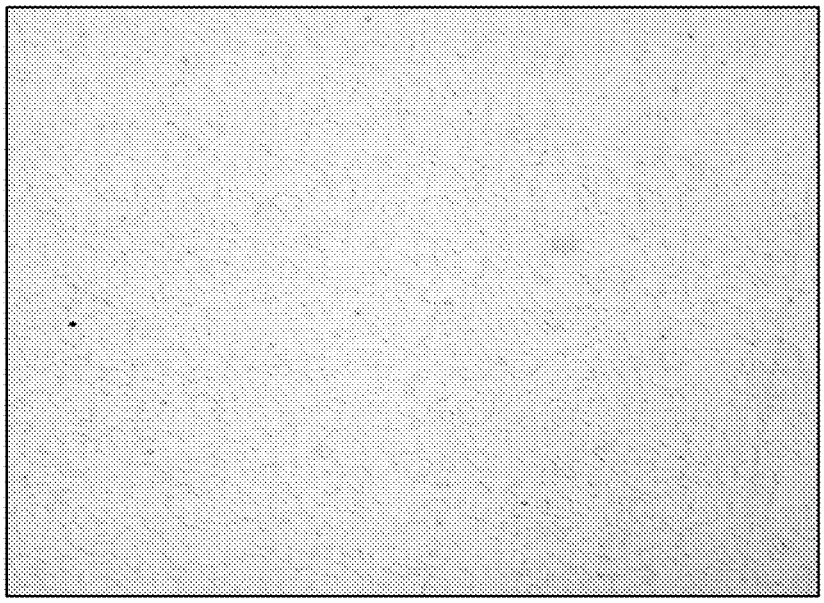
FIG. 9 is a photomicrograph at 100× of a cast comparison alloy.

FIGS. 8 and 9 show the microstructural morphology in J137 alloy with and without aluminum plunge, respectively. FIG. 8 shows aluminum rich nitrides distribution in J137 experiment (Heat 0H28XA) with 0.208 wt. % of aluminum plunge in 100× magnification. With approximate 0.208 weight percent (wt %) of aluminum plunging, a significant amount (~0.01 vol. %) of aluminum nitrides were randomly distributed in J137 matrix with typical size range of 1 to 5 microns, as shown in FIG. 8. FIG. 9 shows aluminum rich nitrides distribution in J137 experiment (0B12R) when low aluminum content was experimented in 100× magnification.

Figure 10:
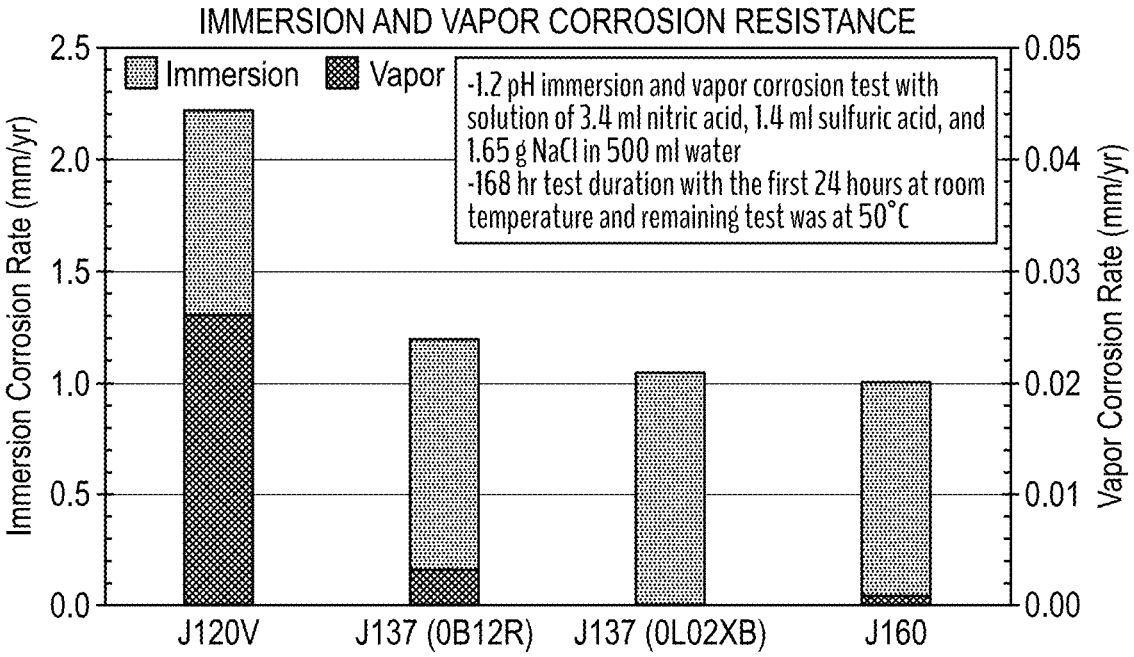
FIG. 10 is a graph of immersion and condensate corrosion test results at 1.2 pH for J137 alloys versus a J120V alloy.
Figure 11:
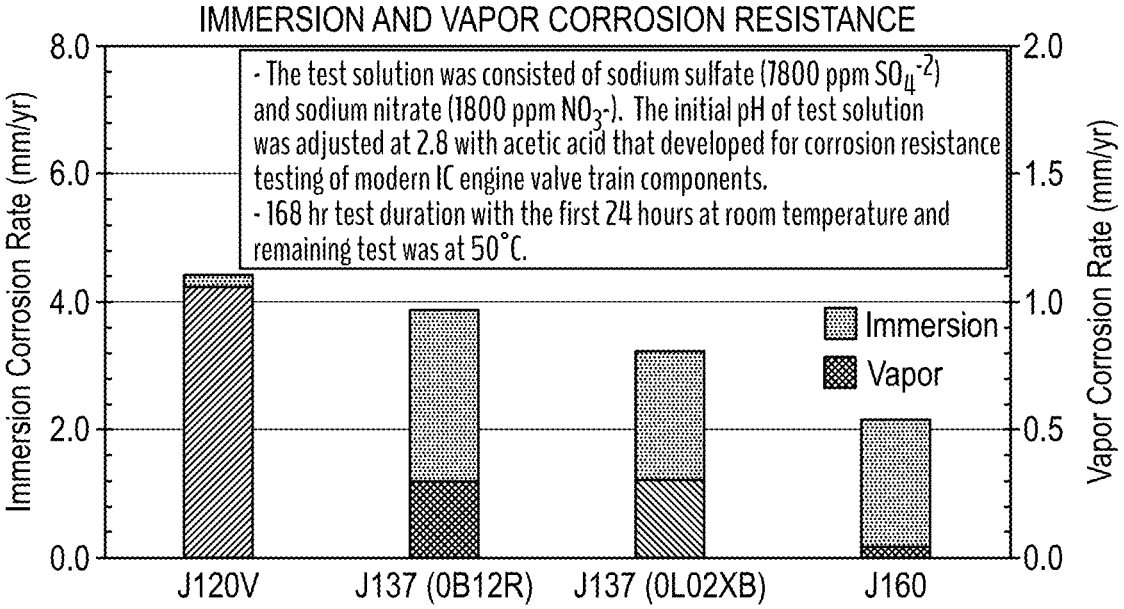
FIG. 11 is a graph of immersion and condensate corrosion test results at 2.8 pH for J137 alloys versus a J120V alloy.

Corrosion resistance of J137 can be exhibited in FIGS. 10 and 11 under 1.2 pH and 2.8 pH testing solution conditions, respectively. The corrosion test includes two portions, a vapor corrosion test and an immersion corrosion test. For 1.2 pH testing, the solution consisted of 3.4 ml nitric acid, 1.4 ml of sulfuric acid, and 1.65 g NaCl in 500 ml $H_2O$. As exhibited in FIG. 10, J137 corrosion resistance is slightly lower than corrosion and wear resistance of L. E. Jones alloy J160 however, but significantly higher than J120V. In addition, the J137 heat with aluminum addition (plunging) showed a noticeably better corrosion resistance than the J137 heat without applying aluminum plunging. FIG. 11 shows the corrosion test results under the 2.8 pH testing condition wherein the solution is composed of sodium sulfate (7800 ppm $SO_4^{-2}$) and sodium nitrate (1800 ppm $NO_3^-$) adjusted with acetic acid to the designed pH value. In general, J137 exhibited a higher corrosion resistance between J120V and J160.

Figure 12A:
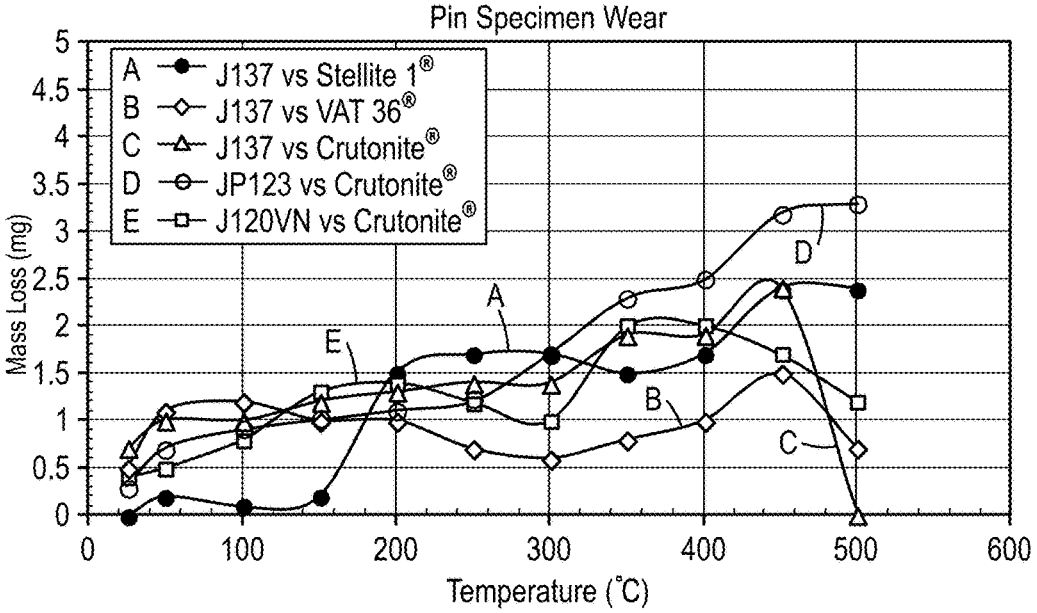
FIG. 12A is a graph of pin specimen wear.
Figure 12B:
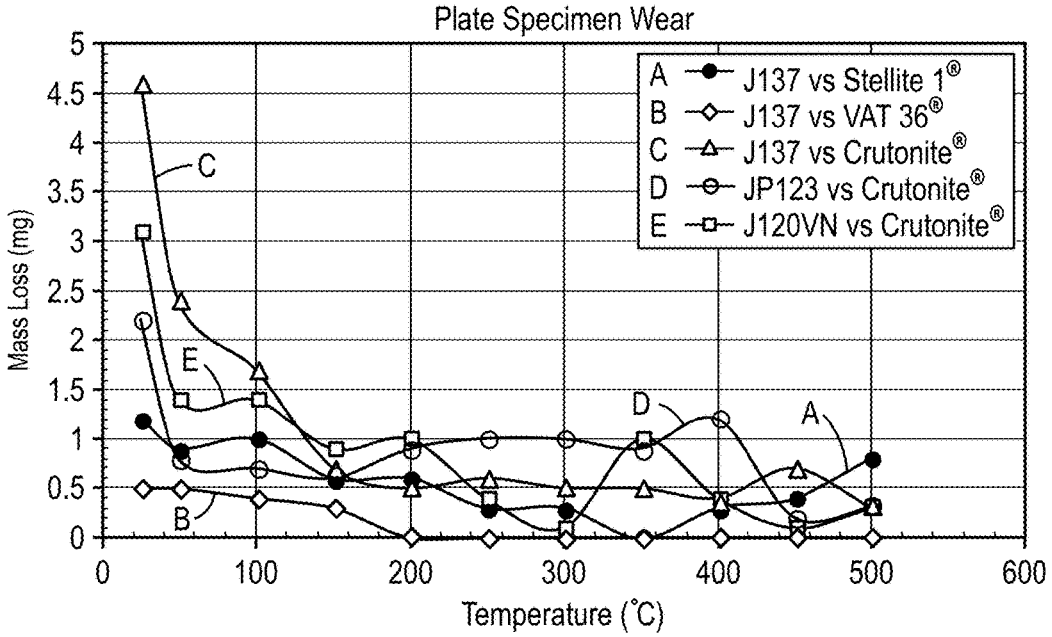
FIG. 12B is a graph of plate specimen wear.
Figure 12C:
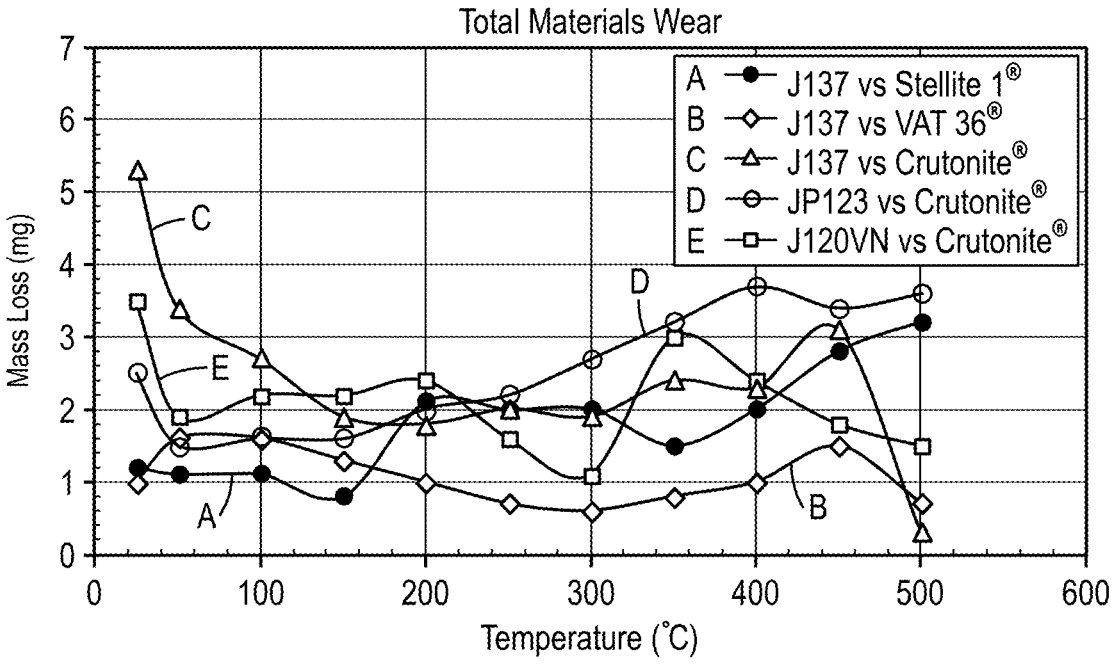
FIG. 12C is a graph of total wear of J137 versus other alloy systems.

The J137 alloy system can be designed to obtain a refined pre-austenite grain size and desired aluminum nitride distribution which enhances wear resistance in an as-cast, quench and tempered condition. FIGS. 12A-C show Plint wear test results of the J137 alloy versus several valve materials along with JP23 and J120VN (nitride J120V) versus Crutonite®. Clearly, the J137 alloy exhibited a sound overall general wear resistance and the J137 alloy versus VAT 36® exhibited the highest wear resistance in this case. FIG. 12A is a graph of pin specimen wear, FIG. 12B is a graph of plate specimen wear, and FIG. 12C is a graph of total wear of J137 versus other alloy systems.

The J137 alloy through its design with fine-grained pre-austenite, copper precipitate hardened, and aluminum nitride dispersive distributed microstructure demonstrated a good wear resistance, good mechanical properties such as hot hardness, compressive yield strength, ultimate tensile strength and radial rupture toughness. It was also clearly demonstrated that J137 possesses a better corrosion resistance than J120V. Thus, it is expected that J137 alloy possesses a better general applicability compared to J120V for valve train component applications.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. An iron-based alloy comprising, in weight percent:
carbon from about 0.75 to about 2 percent;
manganese from about 0.1 to about 1 percent;
silicon from about 0.1 to about 1 percent;
chromium from about 3 to about 6 percent;
nickel up to about 4 percent;
vanadium from about 1 to about 3 percent;
molybdenum from about 4 to about 7 percent;
tungsten from about 4 to about 7 percent;
cobalt from about 4 to about 7 percent;
boron up to about 0.1 percent;
nitrogen from about 0.001 to about 0.15 percent;
aluminum from about 0.001 to about 0.6 percent;
copper from about 0.1 to about 1 percent;
sulfur up to about 0.3 percent;
phosphorus up to about 0.3 percent;
up to about 5 percent total of niobium, tantalum, titanium, hafnium and zirconium;
iron from about 65 to about 80 percent; and
balance incidental impurities, wherein the alloy has a microhardness (HV10) of at least 350 at a temperature of about 1000° F.

2. The alloy according to claim 1, wherein the alloy consists essentially of:
carbon from about 0.75 to about 1.6 percent;
manganese from about 0.2 to about 0.8 percent;
silicon from about 0.2 to about 0.8 percent;
chromium from about 3.5 to about 5.5 percent;
nickel from about 0.05 to about 2.5 percent;
vanadium from about 1.2 to about 2 percent;
molybdenum from about 5 to about 7 percent;
tungsten from about 4 to about 7 percent;
cobalt from about 4.5 to about 7 percent;
boron from about 0.001 to about 0.05 percent;
nitrogen from about 0.05 to about 0.12 percent;
aluminum from about 0.01 to about 0.6 percent;
copper from about 0.2 to about 0.6 percent;
sulfur up to about 0.3 percent;
phosphorus up to about 0.3 percent;
up to about 3 percent total of niobium, tantalum, titanium, hafnium and zirconium;
iron from about 70 to about 76 percent; and
balance incidental impurities wherein total nickel plus cobalt is 8 percent or less.

3. The alloy according to claim 1, comprising:
carbon from about 0.75 to about 1.4 percent;
manganese from about 0.3 to about 0.7 percent;
silicon from about 0.3 to about 0.7 percent;
chromium from about 4 to about 5.5 percent;
nickel from about 0.15 to about 2.5 percent;
vanadium from about 1.2 to about 1.6 percent;
molybdenum from about 5.25 to about 7 percent;
tungsten from about 4 to about 6 percent;
cobalt from about 4.5 to about 6 percent;
boron from about 0.003 to about 0.015 percent;
nitrogen about 0.07 to about 0.1 percent;
aluminum from about 0.01 to about 0.6 percent;
copper from about 0.3 to about 0.5 percent;
sulfur up to about 0.3 percent;
phosphorus up to about 0.3 percent;
up to about 1 percent total of niobium, tantalum, titanium, hafnium and zirconium;
iron from about 70 to about 76 percent; and
balance incidental impurities wherein total nickel plus cobalt is about 5 to about 8 percent.

4. The alloy according to claim 1, comprising:
carbon from about 0.8 to about 1.2 percent;
manganese from about 0.4 to about 0.7 percent;
silicon from about 0.4 to about 0.7 percent;
chromium from about 4 to about 5.5 percent;
nickel from about 0.05 to about 2 percent;
vanadium from about 1.2 to about 1.6 percent;
molybdenum from about 5.5 to about 7 percent;
tungsten from about 4 to about 5.5 percent;
cobalt from about 4.5 to about 5.5 percent;
boron from about 0.005 to about 0.015 percent;
nitrogen from about 0.05 to about 0.1 percent;
aluminum from about 0.01 to about 0.6 percent
copper from about 0.3 to about 0.5 percent;
sulfur up to about 0.3 percent;
phosphorus up to about 0.3 percent;
niobium up to about 1 percent;
titanium up to about 0.1 percent;
iron from about 70 to about 76 percent; and
balance incidental impurities wherein the alloy contains a total of about 15 to about 27 percent cobalt, tungsten, molybdenum and chromium.

5. The alloy according to claim 4, wherein the total cobalt, tungsten, molybdenum and chromium is about 19 to about 24 percent.

6. An iron-based alloy comprising, in weight percent:
carbon from about 0.75 to about 2 percent;
manganese from about 0.1 to about 1 percent;
silicon from about 0.1 to about 1 percent;
chromium from about 3 to about 6 percent;
nickel up to about 4 percent;
vanadium from about 1 to about 3 percent;
molybdenum from about 4 to about 7 percent;
tungsten from about 4 to about 7 percent;
cobalt from about 4 to about 7 percent;
boron up to about 0.1 percent;
nitrogen from about 0.001 to about 0.15 percent;
aluminum from about 0.001 to about 0.6 percent;
copper from about 0.1 to about 1 percent;
sulfur up to about 0.3 percent;

phosphorus up to about 0.3 percent;
up to about 5 percent total of niobium, tantalum, titanium, hafnium and zirconium;
iron from about 65 to about 80 percent; and
balance incidental impurities, wherein the alloy has an as-cast microstructure of about 50 to about 80 volume percent intradendritic phases and about 20 to about 50 volume percent interdendritic phases.

7. An iron-based alloy comprising, in weight percent:
carbon from about 0.75 to about 2 percent;
manganese from about 0.1 to about 1 percent;
silicon from about 0.1 to about 1 percent;
chromium from about 3 to about 6 percent;
nickel up to about 4 percent;
vanadium from about 1 to about 3 percent;
molybdenum from about 4 to about 7 percent;
tungsten from about 4 to about 7 percent;
cobalt from about 4 to about 7 percent;
boron up to about 0.1 percent;
nitrogen from about 0.001 to about 0.15 percent;
aluminum from about 0.001 to about 0.6 percent;
copper from about 0.1 to about 1 percent;
sulfur up to about 0.3 percent;
phosphorus up to about 0.3 percent;
up to about 5 percent total of niobium, tantalum, titanium, hafnium and zirconium;
iron from about 65 to about 80 percent; and
balance incidental impurities, wherein the alloy has a quench and tempered microstructure of about 75 to about 90 volume percent tempered martensite and 10 to about 25 volume percent eutectoid phases.

8. The alloy according to claim 1, wherein the alloy is in a hardened and tempered condition with aluminum nitride and copper precipitates in amounts sufficient to provide a hardness of at least about 45 Rockwell C.

9. The alloy according to claim 1, wherein the alloy consists essentially of, in weight percent:
carbon from about 0.8 to about 1.2 percent;
manganese from about 0.3 to about 0.7 percent;
silicon from about 0.4 to about 0.7 percent;
chromium from about 4 to about 5.5 percent;
nickel from about 0.05 to about 2.5 percent;
vanadium from about 1.2 to about 1.6 percent;
molybdenum from about 5.5 to about 7 percent;
tungsten from about 4 to about 5.5 percent;
cobalt from about 4.5 to about 5.5 percent;
boron from about 0.003 to about 0.015 percent;
nitrogen from about 0.08 to about 0.1 percent;
aluminum from about 0.01 to about 0.6 percent;
copper from about 0.3 to about 0.5 percent;
sulfur up to about 0.3 percent;
phosphorus up to about 0.3 percent;
up to about 1 percent total of niobium, tantalum, titanium, hafnium and zirconium;
iron from about 70 to about 76 percent; and
incidental impurities.

10. A valve seat insert for an internal combustion engine comprising the alloy according to claim 1.

11. A cast part comprising the alloy according to claim 1, wherein the cast part has a microstructure of about 50 to about 80 volume percent intradendritic phases and about 20 to about 50 volume percent interdendritic phases.

* * * * *